US005429536A

United States Patent [19]

Evans

[11] Patent Number: 5,429,536

[45] Date of Patent: Jul. 4, 1995

[54] MONOFIN SWIMMING APPARATUS AND ASSEMBLY METHOD

[76] Inventor: Robert B. Evans, 28 Anacapa St., Santa Barbara, Calif. 93101

[21] Appl. No.: 222,018

[22] Filed: Apr. 4, 1994

[51] Int. Cl.[6] ..... A63B 31/08
[52] U.S. Cl. ..... 441/64
[58] Field of Search ..... 441/61-64

[56] References Cited

U.S. PATENT DOCUMENTS

| | | | |
|---|---|---|---|
| 3,344,449 | 10/1967 | Grilli | 441/64 |
| 3,934,290 | 1/1976 | Le Vasseur | 441/64 |
| 4,541,810 | 9/1985 | Wenzel | 441/64 |
| 4,781,637 | 11/1988 | Caires | 441/61 |
| 4,857,024 | 8/1989 | Evans | 441/64 |
| 4,929,206 | 5/1990 | Evans | 441/64 |

OTHER PUBLICATIONS

Fibra unitary swimming fin advertisement brochure, undated. Distributed/published by Hyperfin.

*Primary Examiner*—Jesus D. Sotelo
*Attorney, Agent, or Firm*—Cislo & Thomas

[57] ABSTRACT

A monofin comprising a swim blade having two adjustable foot pockets for attachment to the feet of a swimmer. The foot pockets can be positioned on the blade to conform with the optimal foot positions for a particular user. The blade itself has a central v-shape, so that when the foot pockets are attached to the blade each pocket leans inwardly towards the other. The blade has upturned outer wing sections to reduce the resistance during the retracting kicking motion. The blade is pitched to channel the flow of water rearwardly and centrally, focussing the water to a point behind the swimmer.

28 Claims, 5 Drawing Sheets

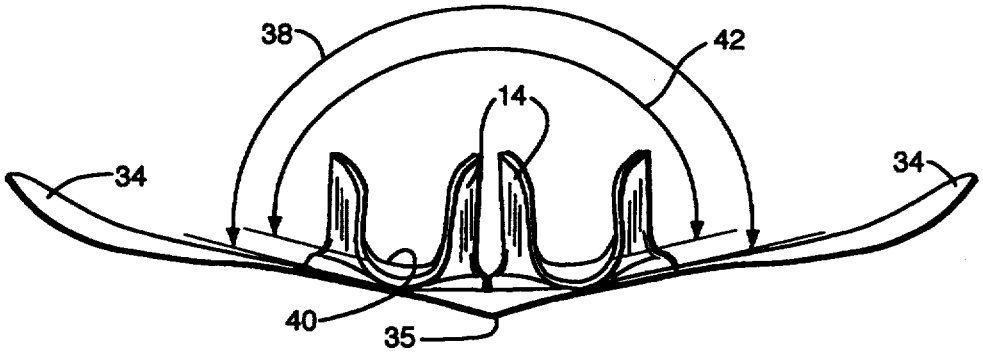
Fig. 5
Fig. 6
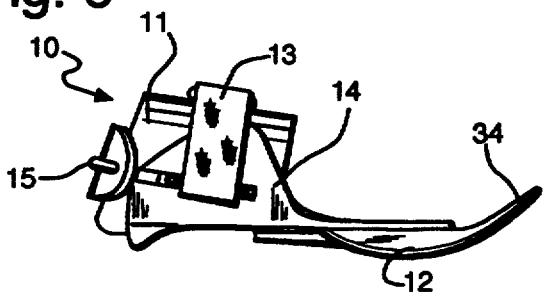
Fig. 7
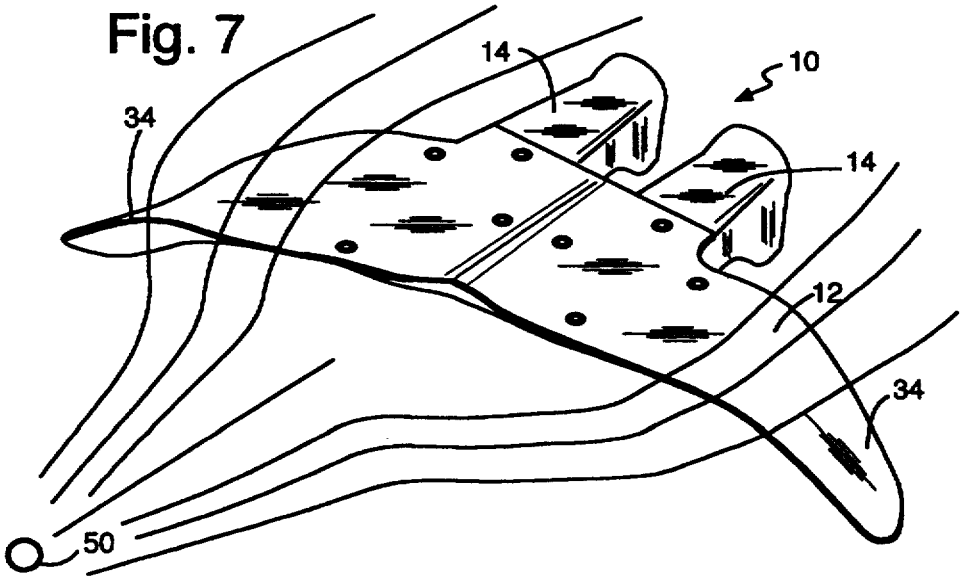

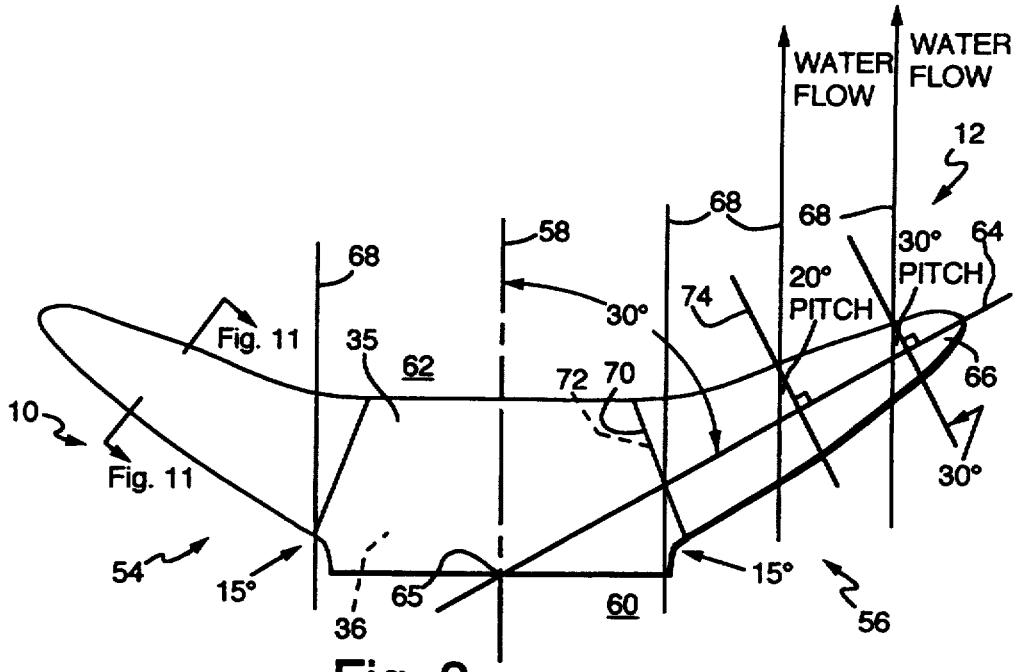
Fig. 8
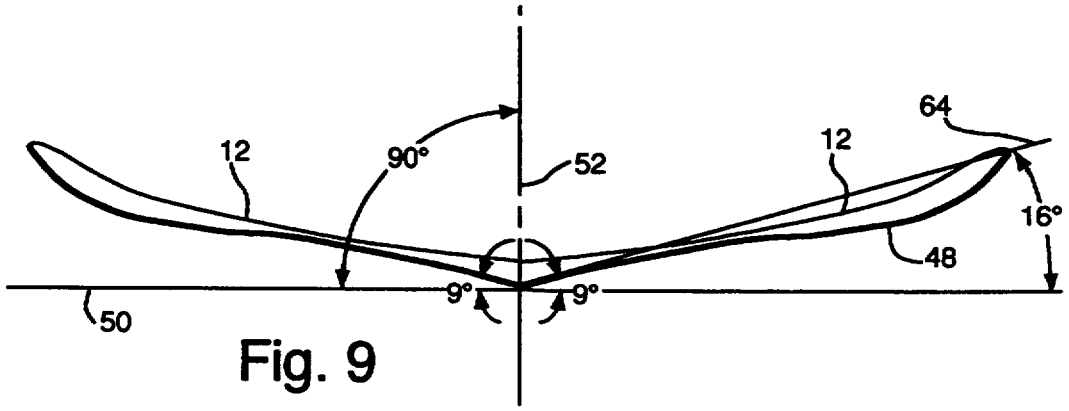
Fig. 9
Fig. 11
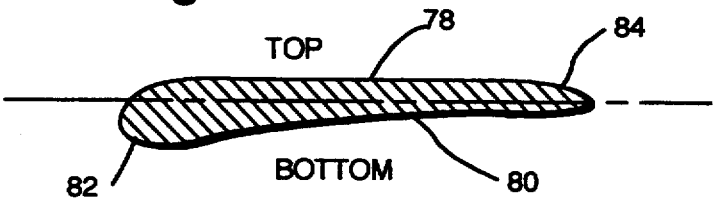

MONOFIN SWIMMING APPARATUS AND ASSEMBLY METHOD

BACKGROUND OF THE INVENTION

1. Field of the Invention

This invention relates to a swim monofin that is adapted to be mounted on the feet of a swimmer for propelling the swimmer through the water, and more particularly to a monofin having feet securing portions that can be selectively and variably positioned to accommodate the physical attributes and preferences of a particular user.

2. Description of the Prior Art

Monofins are primarily used as a competitive swim fin training device. They have applications in, other areas as well, including rehabilitation, scuba and snorkel diving, and high-speed swimming.

It is well known in the prior art to form a monofin for a swimmer, wherein the monofin has two foot-receiving pockets. In the prior art, the receiving pockets are typically formed in the same fashion as foot-receiving pockets on traditional single-foot swim fins. Additionally, the prior art positions the foot pockets in side-by-side, parallel configuration to hold the feet substantially adjacent and parallel.

For example, U.S. Pat. No. 3,934,290 to LeVasseur discloses a swim monofin designed for use as part of a larger swimming apparatus. The monofin has two discrete foot-receiving pockets that hold the feet of the user together in adjacent and substantially parallel fashion. With the user's legs and feet extended, the monofin is substantially aligned with the plane of the swimmer's body. The monofin has conduits in its forward section to divert water rearwardly and outwardly from the fin.

U.S. Pat. No. 4,781,637 to Caires discloses a swim monofin having a wing-like blade, with the blade having a generally tear-dropped cross-section similar to an aircraft wing. The blade comprises a generally flat planar surface, and is designed to produce equal resistance in the extending and retracting kicking motions. The hydrofoil shape directs the flow of water rearwardly and substantially parallel to the swimmer's path. The user's feet are held together in adjacent and parallel configuration, with the soles of the feet roughly defining a common plane.

U.S. Pat. No. 4,541,810 to Wenzel discloses a monofin having an integral foot-receiving pocket designed to accommodate both feet, together and in parallel position, in the single pocket. The fin has an inner stiffener to maintain its shape during use. The fin is specifically designed to maintain constant resistance through the extending and retracting kicking motions. Water passing over the fin is diverted rearwardly and inwardly.

U.S. Pat. No. 3,344,449 to Grilli discloses a mermaid-shaped swimming tail. The tail is designed to resemble a mermaid's fishtail. The fin of the tail is generally triangular-shaped, and in one embodiment has reinforcing ribs to maintain the fins flat shape during kicking. A complex system of these reinforcing ribs allows the fin to collapse in retracting stroke but maintains the fin rigidly flat during the extending stroke. Instead of having two foot pockets, Grilli discloses a single foot boot which positions the feet in adjacent and parallel position. This foot boot inhibits proper angular motion of the foot and ankle.

A prior art monofin marketed under the mark, "Hyperfin Fibra", and as embodied in a published brochure discloses a monofin having a large, generally triangular shape. The fin is large in front-to-back length, with a length of similar size to the width. The foot pockets are an integral part of the monofin and have pockets similar in construction to those found on regular one-foot swim fins. The "Hyperfin" pockets appear to hold the user's feet in side-by-side and parallel relationship.

There are two main problems with the monofins of the prior art. The first problem is the parallel positioning of the feet. The second problem is holding the feet flat relative to each other, i.e., positioning the feet so that their soles are coplanar. The parallel, coplanar positioning of the feet interferes with proper execution of the dolphin kick, which is the most common swimming kick used with monofins.

When executing a proper dolphin kick, the upper legs are held together while the feet are positioned with the ankles spaced further apart than are the toes, resulting in a somewhat "pigeon-toed" stance. This toed-in position allows the swimmer to move his legs and feet in a smooth, efficient motion.

Additionally, during execution of a proper dolphin kick, the soles of the feet do not form a common plane. Instead, the instep of each foot is forced downward relative to that foot's outer edge. Thus, the sole of each foot defines a separate plane from that of the other foot, with the two planes intersecting to form a shallow angle between the two feet.

Holding the feet flat and parallel to each other, as is required with all prior art monofins, causes the swimmer's legs to bow outwardly at the knees, increasing strain along the knee during swimming. Furthermore, such positioning of the feet forces the swimmer to primarily use the weaker inner thigh muscles, as opposed to the larger and stronger outer thigh muscles.

The optimum positions of and distance between, the feet during a dolphin kick vary according to the individual swimmer, taking into account such factors as the swimmer's foot size and ankle flexibility. Monofins having foot pockets permanently fixed in standard positions cannot be tailored for optimal use by particular swimmers.

In theory, monofins should be of great use for therapeutic conditioning and rehabilitation. However, since prior monofin designs are flat and have foot pockets that hold tile feet parallel, their use places large amounts of Stress on the user's lower back and knees. The stress is so great that a good portion of initial monofin race training for competitive athletes is devoted to specific muscular conditioning designed to limit knee and back injury. Paraplegics and those with limited lower back and leg strength, who in theory should be able to benefit greatly from monofin exercises, usually can not Use existing monofins due to the difficulty in overcoming the drag of the blade during the retracting stroke.

The present invention overcomes several of the inherent disadvantages and problems associated with the prior art devices.

SUMMARY OF THE INVENTION

This invention relates to an improved monofin adapted to be mounted onto the feet of a swimmer. In the preferred embodiment, the monofin comprises a swim blade and two separately positionable foot pockets, with each foot pocket receiving one of the user's feet. The foot pockets are selectively positioned on the swim blade according to the specific requirements of individual users.

In one embodiment, the foot pockets secure the user's feet in a non-parallel, pigeon-toed fashion. This pigeon-toed position may involve the front or toe ends of each foot being adjacent or spaced some distance apart from the other foot.

In one embodiment, the foot pockets are non-integral with the swim blade. The foot pockets can De attached to the swim blade in a variety of positions, thereby accommodating the comfort of individual users. The method of attachment may include bolts or other means for non-rotatably securing the pockets to the swim blade.

In another embodiment, the foot pockets are removably attached to the swim blade, allowing the foot pockets to be removed for repositioning or replacement.

The method of attachment may include the process of drilling a bolt hole through the blade and foot pocket to rotatably attach the pocket to the blade by way of a bolt passing through the holes. With the pocket rotatably or pivotally secured to the blade, the user can place his foot in the pocket and rotate the pocket until a comfortable position is reached. With the pocket held in the comfortable position, one or more additional holes are drilled through the blade and pocket. A bolt is placed through each hole to hold the blade and pocket secureely and non-rotatably together.

In a further embodiment, each pocket is adjustably secured to the swim blade, allowing the user to adjust the position of the pocket without having to completely remove the pocket from the blade. An example of such an embodiment allowing for follow-on adjustments by the user uses attachment bolts and bolt holes. However, all or some of the bolts and bolt holes may be replaced with a system of releasable bolts and slotted holes. This allows the pocket's position to be adjusted to an extent by loosening the bolts, sliding the pocket to a new position, and retightening the bolts to secure the pocket in the new position.

The pockets may be manufactured in a variety of sizes or may be custom formed to meet the requirements of particular users. Alternatively, the pockets may themselves be adjustable to accommodate different users.

The blade itself, also referred to as the fin, may comprise a variety of shapes, depending on the particular application or the particular user's requirements.

In one embodiment, the central portion of the swim blade to which the pockets are attached forms a shallow v-shape. Thus, when the foot pockets are attached to the bladeform, each pocket's sole is angled down toward the other sole when viewed from the front or back of the device. Thus, a user's instep is held lower with respect to the rest of the foot than would be the case if the soles of the user's feet were simultaneously placed against a common flat surface.

The blade may include a substantially rigid section at the blade's central portion. This rigid section reinforces the center of the blade where the pockets are attached. It additionally functions to resist bending forces imposed on the center of the blade during use of the monofin. The rigid section may be formed by an embedded steel or fiberglass plate in the polyurethane blade's central portion.

In a further embodiment of the invention, the central portion of the blade is formed of a material that may be permanently bent into other positions. This allows the user to vary the degree of the central blade angle by bending the central portion, thus varying the angle between the solves of the user's feet when the device is worn.

The blade may be generally wing-shaped, having a side-to-side width substantially greater than its front-to-back length. The blade may also have a swept-back shape for reduced drag and other improved performance characteristics.

In a further embodiment, the horizontal and vertical pitch of the monofin blade varies across the width of the blade. The pitch increases toward the outer portions of the blade and is directed rearwardly and inwardly, channeling the flow of water to a central focal point off the back of the fin blade. Thus, the water is focused toward a maximally propulsive point behind the swimmer, increasing the propulsive force of the monofin.

One advantage of the present invention is that it allows the user to select the particular position of each foot pocket. Thus, the monofin can be customized to meet the physical characteristics of particular users.

Another advantage of the present invention is its consideration of the strengths and Weaknesses of the power delivery source, i.e., of the human body. The prior art was primarily designed considering only the hydrodynamic characteristics of the monofin, without placing great emphasis on the strengths, limitations, and variations of the human body. The concentration of force at the instep to heel of the user, coupled with the ability to specifically adjust the angle of the foot pocket and the central angular shape of the blade, properly concentrates the power from the user's strongest kicking muscles toward moving the blade through the water. Thus, propulsive efficiency is maximized with limited muscular strain.

BRIEF DESCRIPTION OF THE DRAWINGS

The foregoing and other advantages and features of this invention will become apparent from the following description of the preferred embodiment when considered together with the illustrations and accompanying drawing which include the following figures:

FIG. 5 is a back plan view of the monofin of FIG. 1, with the securement means 11, 13 and 15 removed for purposes of clarity.

FIG. 6 is a side plan view of the monofin of FIG. 1.

FIG. 7 is a bottom perspective view of the monofin of FIG. 1, showing the flow of water over the fin.

FIG. 8 is a top plan view of the monofin of FIG. 1 showing a bisecting reference line and a right blade reference line to establish and indicate exemplary horizontal pitch angles of the monofin blades.

FIG. 9 is a front elevational view of the monofin of the present invention. For clarity, the foot pockets are not shown so that the elevational or vertical pitch aspects of the blades may be shown more clearly.

FIG. 11 is a side, cross-sectional view of the present invention, showing the change in blade thickness, taken generally along line 11—11 of FIG. 8.

DESCRIPTION OF THE PREFERRED EMBODIMENT

Figure 1:
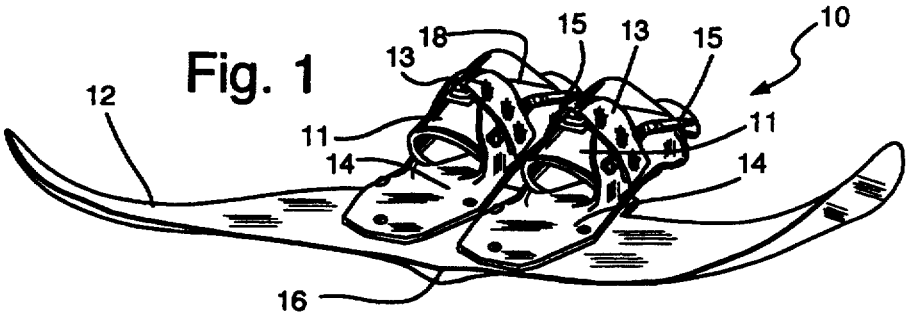
FIG. 1 is a top perspective view of a monofin according to the invention, showing a swim blade and two foot-receiving pockets.

FIG. 1 illustrates a monofin 10 adapted to be mounted on the feet of a swimmer. In the embodiment shown, the monofin has a large wing-like blade 12, with two foot pockets 14 positioned on the blade. Each of the foot pockets 14 is designed to comfortably receive and secure the foot of a user. The wing-like blade 12 is shaped to allow the swimmer to maximize his swimming speed. The instep cushions 11 and instep belt securements 13 and heel straps 15 complete the main components of monofin 10.

The foot pockets 14 are shown attached on either side of the center 16 of the blade. When worn, the foot pockets 14 secure the user's feet (not shown) with the tops of the user's feet toward the tops 18 of the pockets.

Figure 2:
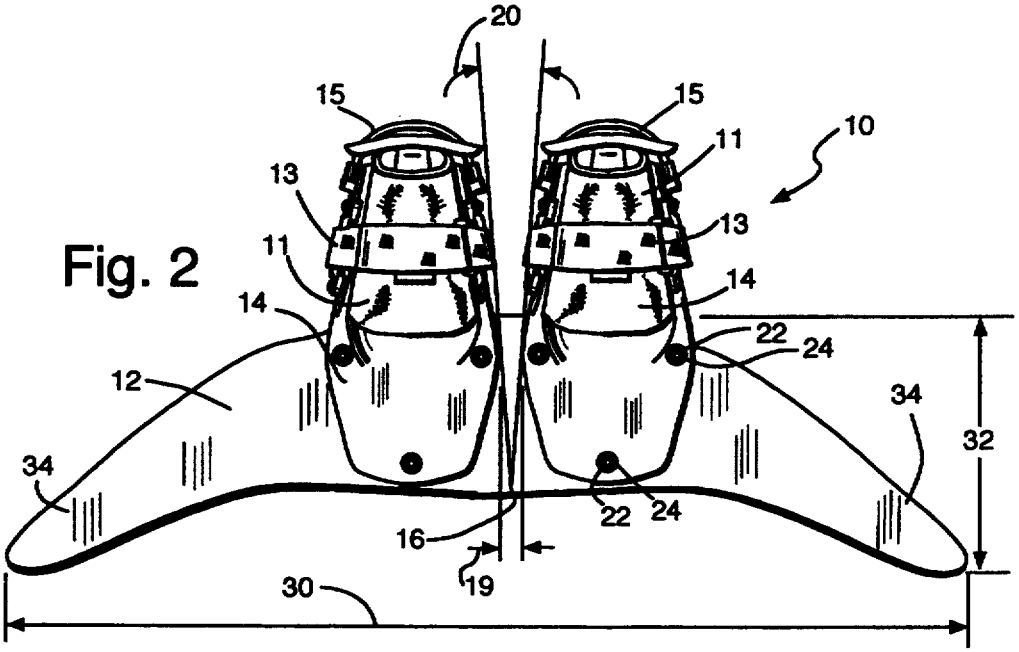
FIG. 2 is a top plan view of the monofin of FIG. 1.

FIG. 2 shows the monofin as viewed from directly above. Of critical importance are the distance and angle between the user's feet, which is a function of the distance 19 and angle 20 between the foot pockets. Each of the preferred distance 19 and angle 20 varies from user to user according to the particular individual's physical characteristics. The construction of the present invention allows the user to select the distance 19 and angle 20 between the foot pockets 14 to meet his own comfort requirements.

The foot pockets 14 are detachable so that they can be repositioned on the blade 12 according to the specific requirements of the user. In the embodiment shown in FIG. 2, the foot pockets 14 are bolted to the blade through a series of bolts 22 through bolt holes 24 passing through the pockets 14 and blade 12 and secured by countersunk nuts 23. The bolts 22 may be removed, and additional holes 24 may be drilled in either the pockets 14 or the blade 12 to reposition the pockets 14. This removability of the components allows individual pockets 14 or the blade 12 itself to be replaced as required, as for example where a component is damaged.

In another embodiment, the foot pockets can be relocated on the blade without completely detaching the pockets. In the embodiment shown in FIG. 2*a*, the foot pockets 14 are bolted to the blade 12 through a series of bolts 26 disposed in the holes. All holes in the blade are sized to tightly encircle the bolt. However, only one of the holes in each pocket is of that size, which in the particular embodiment shown are the holes 26 in the toe of the pocket 14. The other holes shown in each pocket 14 are formed as slots 28, with the slots 28 defining arcs generally centered on the toe bolt hole 26. Thus, loosening the bolts (not shown) in the slotted holes 28 allowing each foot pocket 14 to be rotated about its toe to another angle. When the bolts are tightened, the pocket 14 is held securely in the new position.

Another alternative is to place the slotted holes in the blade and make only tight-fitting circular holes in the pockets.

Figure 2A:
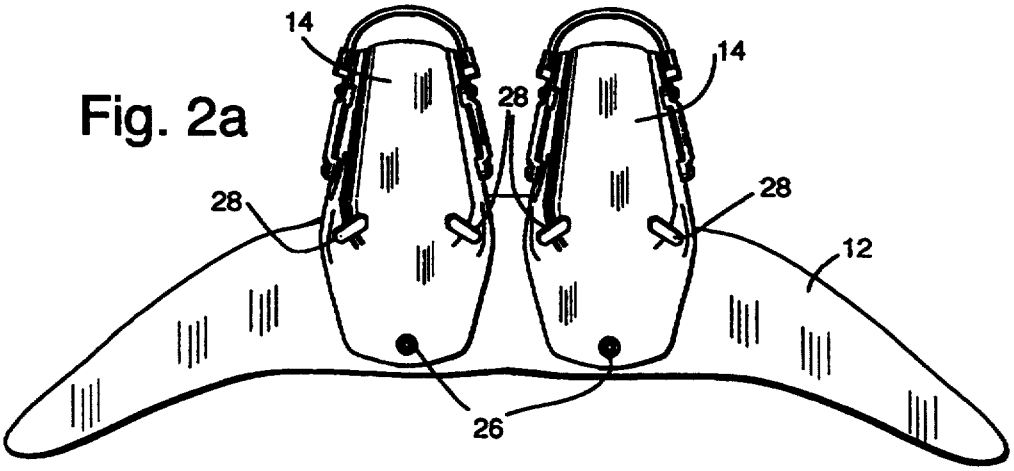
FIG. 2*a* is a partial view of another embodiment of the monofin shown in FIG. 2, showing an alternative attachment device, with instep and heel securement means removed for purposes of clarity.

The bolts 26 and 28 and their corresponding nuts (not shown) in FIGS. 2 and 2*a* may be countersunk to be level with the surface of the pockets 14 and blade 12. The resulting lower bolt and nut profile reduces the drag from the bolts and nuts or fasteners as well as reducing the chance of injury to the user or third parties who may contact the bolt. Obviously, the nuts or fasteners may be embedded in the blade, provided fixed, non-customized foot pockets are desired.

While bolts are shown in the above embodiments, it is noted that other connection and attachment methods may also be used, such as rivets, screws, etc.

The blade 12 itself may be formed of polyurethane or other suitably resilient material. The blade is preferably of general wing shape, having a side-to-side width 30 substantially greater than its front-to-back length 32. The blade as seen in FIG. 2 has a gradual tapering toward the outer sections 34, and further has a swept-back shape. This swept-back shape helps to reduce drag. It also helps to deflect the water flow rearwardly and centrally, concentrating the water centrally behind the swimmer.

Figure 3:
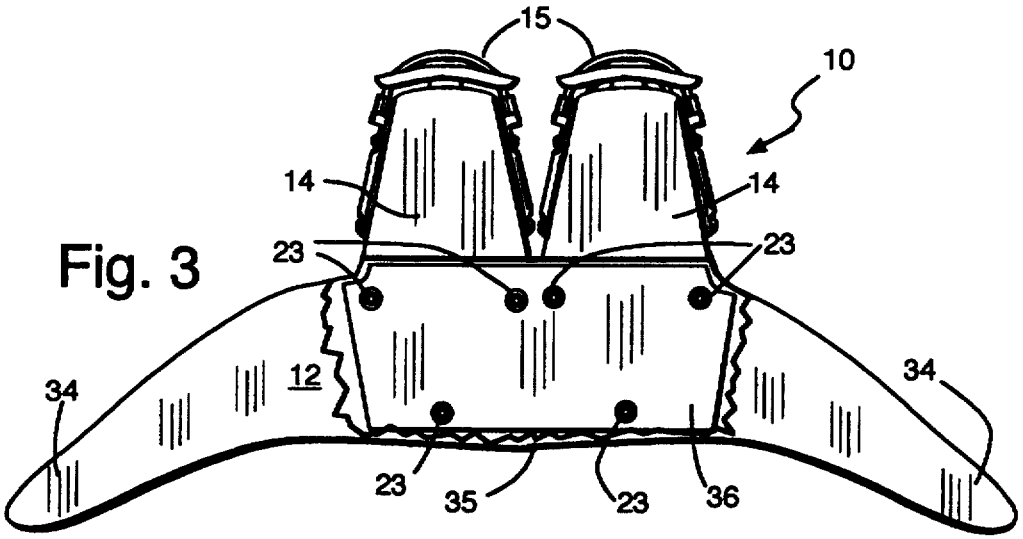
FIG. 3 is a bottom plan view of the monofin of FIG. 1.

FIG. 3 is a view of the bottom of the monofin 10, showing the nuts 23 attached to the bolts 22. In the embodiment shown, the blade 12 includes an embedded, substantially rigid member 36 at the central portion 35 of the blade 12. Rigid member 36 reinforces the central portion 35 of blade 12 where the pockets 14 are attached, strengthening the attachment points to reduce the chance of the pockets 14 being torn from blade 12. Rigid mender 36, of plate steel or fiberglass or composite construction additionally functions to resist bending forces imposed on the center 35 of the blade 12 during use of the monofin 10.

Figure 4:
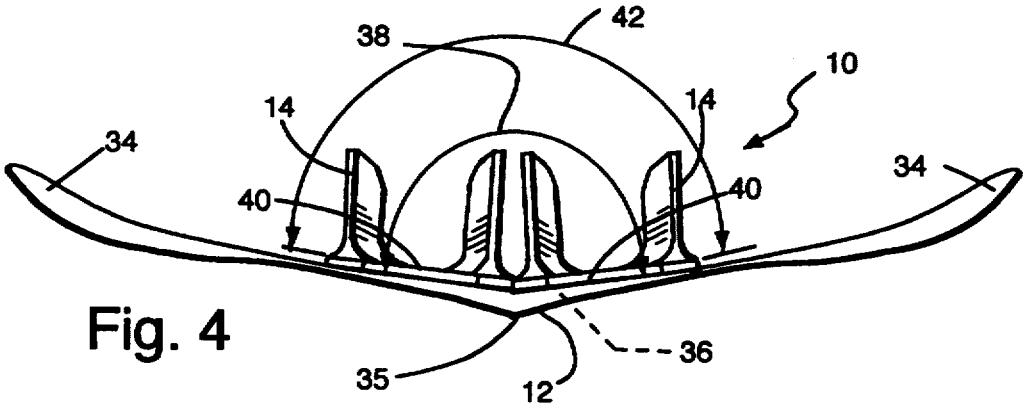
FIG. 4 is a front plan view of the monofin of FIG. 1, with the securement means 11, 13 and 15 removed for clarity.

FIGS. 4 and 5 are front and back views, respectively, of monofin 10. The central portion 35 of the blade has a generally shallow v-shape. The foot pockets 14 are attached to the blade 12, with one pocket 14 on either side of the central v-shaped portion. Due to the angle 38 of the central v-shape, the pockets 14 lean inwardly toward each other and toward the center of the blade 12, so that the pockets 14 are positioned with their inner soles 40 in a non-coplanar position. This inward lean causes the intersection of the planes defined by the inner sole 40 of each foot pocket 14 to form a shallow angle 42, which is the angle between the soles of the user's feet, not shown. This shallow angle 42, which in FIG. 4 is equal to angle 38, accommodates the comfort position of the user, allowing the soles of the user's feet to be non-coplanar when the user is executing a dolphin kick with the inventive device.

Figure 4A:
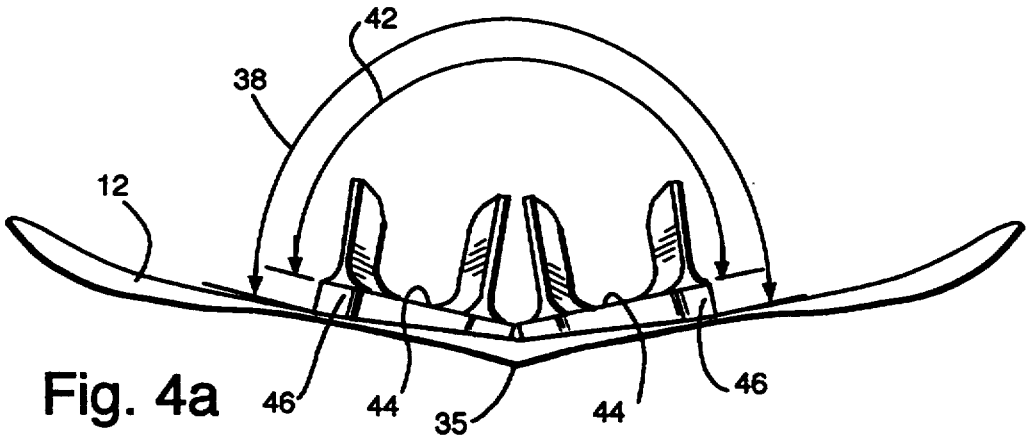
FIG. 4*a* is a partial view of another embodiment of the monofin depicted in FIG. 4, showing an alternate foot pocket design.

For a user whose comfort position requires a greater or lesser angle 42 between the soles of his feet, blades with different central angles 38 may be used. Alternatively, customized foot pockets may be used which vary the sole angle. FIG. 4*a* shows customized foot pockets 44 that increase the sole angle 42 between the user's soles by having additional thickness at the outer portions 46 of the pocket sole. Another option to vary the effective sole angle is the use of angled slats between the blade and foot pocket.

In another embodiment, the central portion 16 of the blade 12 may comprise material that can be bent to a lesser or greater central angle 38. This allows a user to self-customize the blade by varying the blade's angle to meet the user's particular requirements.

Referring to the embodiment shown in FIGS. 4 and 5, it is seen that portions 34 of the blade 12 beyond the central portion 35 continue to curve slightly upward relative to a plane drawn from the central portion 35 of the blade 12. This serves to limit the resistance to the retracting kicking motion, thereby reducing lower back stress on the user.

As stated, the outer portions 34 of the blade 12 curve upward to a greater extent than the remainder of blade 12. This upward curve of the outer portions 34 integrates into the swimmer's kick an upward recovery motion, which further limits the resistance to the retracting kicking motion.

An additional feature is the variable pitch of the blade 12. The pitch increases toward the outer portions 34 of the blade 12. Additionally, as shown in FIG. 7, the pitch is directed rearwardly and centrally toward a focal point 50 behind the device 10. This varied pitch channels the water flow toward the central focal point behind the swimmer, thereby maximizing the speed attainable with minimal effort.

FIG. 7 is a bottom perspective view of a monofin 10 according to the invention, showing the flow of water over the fin. As shown in the figure, the pitch and swept-back shape of the blade 12 channels the water rearwardly and centrally toward a point 50 behind the fin.

Figure 10:
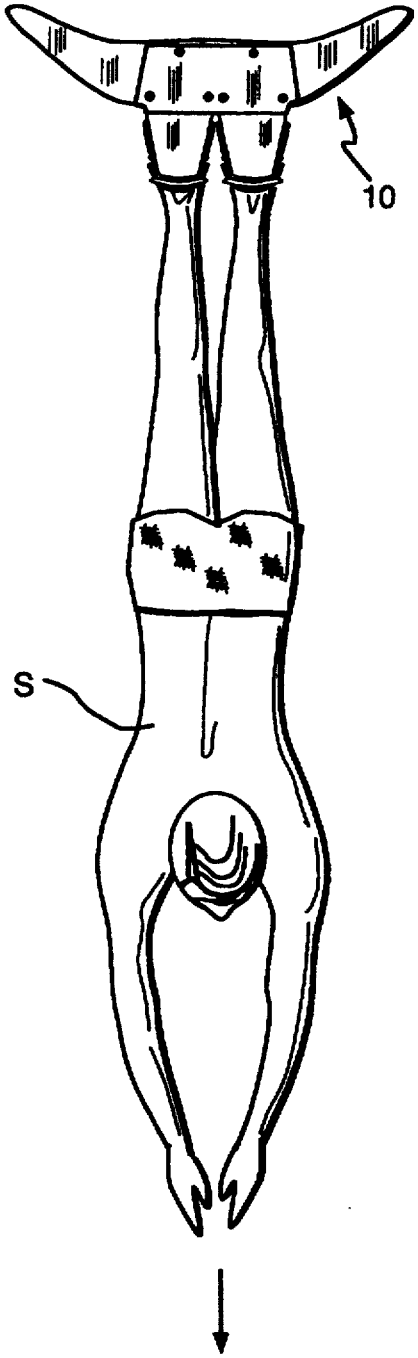
FIG. 10 is a top plan view of a human being swimming with the monofin of the present invention.

In order to enhance the performance of monofin 10 of the present invention, blades 12 of monofin 10 are rearwardly curved so that when monofin 10 is worn, blades 12 are pointing to the rear of and away from the swimmer S. In other words, monofin 10 is curvilinearly shaped to curve away from swimmer S towards the rear (FIG. 10).

Referring now to FIGS. 8 and 9, in order to well define the angular aspects of monofin 10, certain reference lines and planes are used from which the angular features of monofin 10 depart. If monofin 10 were laid put flat, undersurface 48 would rest in a plane that is here denominated the "major reference plane" 51, best shown in FIG. 9. Perpendicular to this major reference plane, a "minor reference plane" 52 can be designated as bisecting monofin 10 into equal leer 54 and right 56 sections, each of which are mirror images of the other. For purposes of discussion and disclosure, "center and reference lines" are defined here as running parallel to major reference plane 51 in minor reference plane 52. References made herein to a center line 58 should be considered as referring to that center line nearest to the object or other reference line in question at the time.

As indicated in FIG. 8, water flow is defined as flowing from the front or swimmer's side 60 of monofin 10 to the rear or water side 62 of monofin 10. Water flow is defined here as flowing parallel to minor reference plane 52. While blades 12 direct water towards a central focal point 50 (FIG. 7) behind swimmer S (thereby maximizing the speed attainable with minimal effort), the general direction of water flow is considered to move past the swimmer in a direction generally parallel to minor reference plane 52.

Referring to FIG. 9, two other imaginary reference lines are set forth herein so that the angles established by monofin 10 may be discussed with specificity. The first of these lines is a right side blade reference line 64. The second is a left side blade reference line (not shown) that is the mirror image of right side blade reference line 64.

As seen in FIG. 8, right side reference line 64 is shown extending from the intersection 65 of front edge 60 of monofin 10 and center line 58 to right most extension 66 of blade 12. The left side blade reference line may be established in similar manner. As monofin 10 is symmetrical about its minor reference plane 52, the description given here for right side 56 of monofin 10 is equally true in a corresponding manner for left side 54.

The right blade reference line 64 is at an angle of approximately 30° to minor reference plane 52. Where blade 12 attaches to the foot floor base or embedded, substantially rigid member 36, an angle of horizontal fin pitch of approximately fifteen degrees (15°) is defined between the general water flow direction indicated by arrows 68 parallel to minor reference plane 52 and perpendicular 70 to right blade reference line 64.

At a point on right blade reference line 64 approximately central between area 72 at rigid member 36 and extreme right most end 66 of blade 12, an angle of approximately twenty degrees (20°) of horizontal pitch is defined between perpendicular 74 to right blade reference line 64 and the general direction of water flow indicated by arrows 68. At a point approximately four-fifths (4/5) of the way between blade area 72 and right most tip of right side blade 66, an angle of horizontal pitch of approximately thirty degrees (30°) is defined between perpendicular 76 to right blade reference line 64 and the general direction of water flow as indicated by arrows 68. As mentioned above, the angular relationships between right side perpendiculars (70, 74, and 76) and the direction of water flow as indicated by arrows 68 are correspondingly true for the left blade reference line and direction of water flow as indicated by arrows 68.

The angular range for horizontal fin pitch is set forth above as varying from zero degrees (0°) near minor reference plane 52 to approximately thirty degrees (30°) near end tip 66 of blade 12. Alternatively, this angular range may also vary from zero degrees (0°) to forty-five degrees (45°).

As shown in FIG. 9, the front view of monofin 10 is shown with its varying degree of upward or vertical pitch with respect to distance from central region 35 of monofin 10. At a distance approximately where blade 12 has rigid member 36, an angle of approximately nine degrees (9°) is defined between major reference plane 51 and that portion of monofin 10 having substantially rigid member 36. As travel is extended further and outward along blade 12, an angle of sixteen degrees (16°) is defined between further most tip 66 of blade 12 of monofin 10 and plane 51 determined by the bottom surface 48 of monofin 10. It is contemplated that the nine to sixteen degrees (9° to 16°) change in vertical pitch is distributed continuously over each of the blades 12.

FIG. 10 shows a human swimmer S using monofin 10. As shown in FIG. 11, upper surface 78 of monofin 10 is flat. The monofin 10 is thicker in front edge 82 of underside 80 and tapers towards back end 84 to provide more resistance in response to compression of thickened material as the arc of the blade increases throughout the kick cycle. That is, like a fin found on a fish or an aquatic mammal, blades 12 are thicker nearer swimmer S and taper as travel is made away from the swimmer. The thickened portion of blades 12 serves to provide support for the thinner portions and acts as means by which blade 12 may be pivotally or torsionally compressed in a spring-like manner. The energy absorbed by the thicker portions of blades 12 is released upon the ensuing and oppositely directed stroke of the swimmer's kick. The spring-back of the compressed material increases the velocity of water flowing by blade 12 and assist the swimmer on the recovery stroke of the kick.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the appended claims. For example, those of ordinary skill in the art will recognize that conventional swim fin materials such as polyurethane for the fin, foam for the instep and heel, and polymer belting for fastening means may be employed in the practice of the invention.

I claim:

1. A swimming apparatus for use by a human user, said apparatus comprising:

fin means for propelling the user through the water; and foot-securing means for removably securing both the user's feet to the apparatus in non-parallel, pigeon-toed fashion.

2. The swimming apparatus of claim 1, wherein said foot-securing means is connected to but non-integral with the fin means, and further including:

attachment means for connecting the foot-securing means to the fin means, said attachment means allowing the foot-securing means to be attached to the fin means at any selected one of a plurality of positions.

3. The swimming apparatus of claim 2, wherein the foot-securing means comprises two separate foot pockets, with each foot pocket securing one of the user's feet to the apparatus, and each foot pocket being capable of attachment to the fin means at a position independent of the other foot pocket.

4. The swimming apparatus of claim 3, wherein the attachment means comprises: a plurality of fasteners passing through each foot pocket into the fin means.

5. The swimming apparatus of claim 3, wherein the attachment means movably secures the foot pockets to the fin means, thereby allowing the foot pockets to be selectively repositioned by the user.

6. The swimming apparatus of claim 5, wherein the attachment means comprises:

one rotational fastener passing through each foot pocket into the fin means, said rotational fastener allowing the foot pocket to rotate about the rotational fastener;

at least one releasable fastener passing through a slot in each foot pocket and into a hole in the fin, said slot defining a general arc segment centered on the rotational fastener; and said releasable fastener when released allowing the rotation of the foot pocket about the rotational fastener;

whereby the foot pocket can be non-rotatably secured to the apparatus at a variety of angles.

7. The swimming apparatus of claim 3, wherein the fin means comprises a relatively flexible wing-like blade formed of a resilient flexible material, the blade having a central and outer portions, with the blade's side-to-side width being substantially greater than the blade's front-to-back length.

8. The swimming apparatus of claim 7, wherein the wing-like blade further includes a substantially rigid plate located at the central portion of the blade, with the foot securing means attached to the blade through said substantially rigid plate.

9. The swimming apparatus of claim 7, wherein the wing-like blade extends outwardly from the sides of the foot-securing means in a swept-back configuration.

10. The swimming apparatus of claims 7, 8, or 9, wherein the central portion of the blade where the foot pockets are attached forms a shallow V-shape, whereby each of the foot pockets leans inwardly toward the other pocket and the central portion of the blade.

11. The swimming apparatus of claim 10, wherein the blade has a shape which offers greater resistance during an extending stroke than during a retracting stroke.

12. The swimming apparatus of claim 11, wherein the outer portions of the wing-like blade curve upward.

13. The swimming apparatus of claim 1, wherein the foot receiving means positions the soles of the user's feet in non-coplanar fashion, whereby two planes which are each roughly defined by the sole of one of the user's feet intersect along an imaginary line passing roughly between the foot pockets in a generally longitudinal direction.

14. A swimming apparatus for use by a human user, said apparatus comprising:

fin means for propelling the user through the water;

foot-securing means for removably receiving both the user's feet, said foot-securing means connected to but non-integral with the fin means; and attachment means for connecting the foot-securing means to the fin means, said attachment means allowing the foot-securing means to be attached to the fin means at any of a plurality Of positions.

15. The swimming apparatus of claim 14, wherein the foot-securing means comprises two foot pockets, with each of said foot pockets being capable of securing one of a user's feet to the apparatus, and wherein the attachment means independently secures each foot pocket to the fin means, whereby each foot pocket can secure one of a user's feet to the apparatus at a position selected by the user.

16. A swimming apparatus for use by a human user, said apparatus comprising:

a propulsion blade having a central longitudinal axis, a central portion, and outer portions;

two foot pockets for securing a user's feet to the propulsion blade, each of said foot pockets hating an inner and outer edge and a lower surface, said foot pockets further being attached to the propulsion blade at the central portion of the blade, with one foot pocket being located at either side of the central longitudinal axis of the blade; and the center of said propulsion blade having a shallow v-shape between the outer edges of the attached foot pockets;

whereby each of the foot pockets leans inwardly toward the other pocket and the central portion of the blade.

17. The swimming apparatus of claim 16, wherein the blade comprises a relatively flexible wing-like portion, the wing-like portion extending outwardly from the sides of the foot pockets and having a side-to-side width substantially greater than the blade's front-to-back length.

18. The swimming apparatus of claim 17, wherein the blade has a shape which offers greater resistance during an extending stroke than during a retracting stroke.

19. The swimming apparatus of claim 18, wherein the wing-like portion extends outwardly from the sides of the foot-securing means in a swept back configuration.

20. The swimming apparatus of claim 19, wherein the pitch of the wing-like blade increases toward the outer portion of the wing, whereby water passing over the blade is channelled generally toward a point behind the blade.

21. In a monofin comprising a swim blade and two foot pockets, with each foot pocket formed to receive a user's foot, a method of attaching each foot pocket to the blade fin alignment with the user's desired angular position and desired width position, comprising the steps of:

inserting one of the user's feet in the foot pocket;

placing the pocket on the swim blade at the user's desired width position;

aligning the pocket on the swim blade to the user's desired angular position; and non-rotatably securing the foot pocket to the blade at the desired width position and angular position.

22. The method of claim 21, wherein the step of placing the pocket at the desired width position is performed prior to the step of aligning the pocket to the desired angular position, and including, prior to the step of aligning the pocket to the desired angular position, the further step of:

rotatably attaching the foot pocket to the blade.

23. The method of claim 21, wherein the steps of placing the pocket at the desired width position and aligning the pocket to the desired angular position are performed as an integral step.

24. A swimming apparatus for use by a human user, said apparatus comprising:

fin means for propelling the user through the water, said fin means increasing in horizontal and vertical pitch as said fins means extends away from a central section;

two foot pockets, with each of said foot pockets being capable of securing one of a user's feet to the apparatus, whereby each foot pocket can secure one of a user's feet to the apparatus at a position selected by the user, said foot pockets connected to but non-integral with said fin means; and attachment means for connecting said foot pockets to said fin means, said attachment means allowing said foot pockets to be attached to said fin means at any of a plurality of positions, said attachment means independently securing each foot pocket to said fin means.

25. The swimming apparatus of claim 24, wherein said increasing vertical pitch increases continuously from about nine degrees (9°) adjacent to said central section to about sixteen degrees (16°) at the furthest most tip of said fin means.

26. The swimming apparatus of claim 24, wherein said increasing horizontal pitch increases continuously from about fifteen degrees (15°) adjacent to said central section to about thirty degrees (30°) at generally the furthest most tip of said fin means.

27. The swimming apparatus of claim 24, wherein said central section has a top portion which is flat and an underside portion that has a thicker front edge that tapers to a back edge to provide better performance by the swimming apparatus.

28. A swimming apparatus for use by a human user, said apparatus comprising:

fin means for propelling the user through the water, said fin means increasing in horizontal pitch continuously from about fifteen degrees (15°) adjacent to a central section to about thirty degrees (30°) at generally a furthest most tip of said fin means, and said fin means increasing in vertical pitch continuously from about nine degrees (9°) adjacent to said central section to about sixteen degrees (16°) at the furthest most tip of said fin means, said central section having a top portion which is flat and an underside portion that has a thicker front edge that tapers to a back edge to provide better performance by the swimming apparatus;

two foot pockets, with each of said foot pockets being capable of securing one of a user's feet to the apparatus, whereby each foot pocket can secure one of a user's feet to the apparatus at a position selected by the user, said foot pockets connected to but non-integral with said fin means; and attachment means for connecting said foot pockets to said fin means, said attachment means allowing said foot pockets to be attached to said fin means at one of a plurality of positions, said attachment means independently securing each foot pocket to said fin means.

* * * * *